US006174068B1

(12) United States Patent
Ambach et al.

(10) Patent No.: US 6,174,068 B1
(45) Date of Patent: Jan. 16, 2001

(54) LIGHT FIXTURE WITH AUXILIARY LIGHT

(75) Inventors: Douglas Ambach, Hamilton; Dennis J. Gallant, Harrison, both of OH (US)

(73) Assignee: Hill-Rom, Inc., Batesville, IN (US)

( * ) Notice: Under 35 U.S.C. 154(b), the term of this patent shall be extended for 0 days.

(21) Appl. No.: 09/162,354

(22) Filed: Sep. 29, 1998

Related U.S. Application Data

(60) Provisional application No. 60/065,695, filed on Nov. 14, 1997.

(51) Int. Cl.[7] ..... F21S 8/00

(52) U.S. Cl. ..... 362/147; 362/217; 362/220; 362/225; 362/257

(58) Field of Search ..... 362/147, 220, 362/225, 287, 372, 480, 148, 222, 217, 257

(56) References Cited

U.S. PATENT DOCUMENTS

| | | | |
|---|---|---|---|
| 2,215,531 | 9/1940 | Piper . | |
| 2,998,508 | 8/1961 | Bobrick . | |
| 3,084,247 | 4/1963 | Bobrick . | |
| 3,201,582 | 8/1965 | Siegel . | |
| 3,354,301 | 11/1967 | Bobrick . | |
| 3,660,591 | 5/1972 | Schultz et al. . | |
| 3,702,928 | 11/1972 | Alger . | |
| 3,769,502 | 10/1973 | Schultz et al. . | |
| 3,919,540 | 11/1975 | Burst et al. . | |
| 4,097,919 | 6/1978 | Bobrick et al. . | |
| 4,204,274 | 5/1980 | Lüderitz . | |
| 4,646,211 | 2/1987 | Gallant et al. . | |
| 4,651,258 | 3/1987 | Davis et al. . | |
| 4,752,863 | 6/1988 | Parrott . | |
| 4,894,755 | 1/1990 | Chandler . | |
| 5,169,226 | 12/1992 | Friedman . | |
| 5,272,608 | 12/1993 | Engle . | |
| 5,539,626 | 7/1996 | Scholz . | |
| 5,735,593 * | 4/1998 | Gallant et al. | 362/147 |
| 5,918,972 * | 7/1999 | Van Belle | 362/480 |

* cited by examiner

*Primary Examiner*—Sandra O'Shea
*Assistant Examiner*—Bertrand Zeade
(74) *Attorney, Agent, or Firm*—Barnes & Thornburg

(57) ABSTRACT

A light fixture apparatus includes a support frame mounted to the wall and an auxiliary or examination light source coupled to the support frame and movable from a first stored position to a second deployed position. A first switch in series with the auxiliary light source is opened when the auxiliary light is in the stored position and closed when the auxiliary light is in the deployed position. The light source has three degrees of adjustment. The light source is connected to one end of telescopic members which are pivotally connected at its second end to the support to pivot about an axis transverse the telescoping axis. A safety switch is provided adjacent the telescopic members to sense the pivoting.

30 Claims, 8 Drawing Sheets

LIGHT FIXTURE WITH AUXILIARY LIGHT

CROSS-REFERENCE

This application claims the benefit of U.S. Provisional Application Ser. No. 60/065,695, filed Nov. 14, 1997 with respect to common subject matter and is incorporated herein by reference.

BACKGROUND AND SUMMARY OF THE INVENTION

The present invention relates generally to light fixture apparatus for mounting on a wall of a room and more particularly to an improved patient auxiliary light mounted to the wall of a hospital room.

Some conventional hospital rooms are provided with a track mounted on a wall of the hospital room. Lights, electrical outlets and various other ancillary equipment are mounted to this track. A typical example is the Integris Patient Light and Headwall System available from Hill-Rom of Batesville, Ind. and is described in U.S. patent application 08/705,214 filed Aug. 29, 1996, which is incorporated herein by reference. The auxiliary light source disclosed in the aforementioned mentioned rotates about an axis parallel to the wall and may be used as an examination light. Such light has only one degree of freedom of adjustment.

The present invention provides an auxiliary or examination light for a hospital room which has more than one degree of freedom of adjustment.

The light fixture apparatus of the present invention is configured to be mounted onto the wall of the room, preferably a hospital room. It includes a support frame mounted to the wall and an auxiliary or examination light source coupled to the support frame and movable from a first stored position to a second deployed position. Also, depending upon the light fixture, it may include another light box coupled with a frame and including a light source. A first switch in series with the auxiliary light source is opened when the auxiliary light is in the stored position and closed when the auxiliary light is in the deployed position. An on/off switch is connected in series with the first switch and the auxiliary light source. While the on/off switch is preferably coupled to the support frame, the first is coupled to the support frame to detect the stored or deployed position of the auxiliary light source. A transformer for the light source is coupled to the support frame and connected electrically to the first switch and the auxiliary light source. Also, a fan may be coupled to the auxiliary light source and connected electrically to the first switch and the auxiliary light source.

A pair of telescopic members move relatively to each other along a first axis and couple the auxiliary light source to the support frame. Telescopic members allow the auxiliary light source to move from the stored position to the deployed position. The auxiliary light source is rotatably connected to a first end of the telescopic members. A bracket is pivotally connected to the first end of the telescopic members to pivot about a second axis transverse to the first axis. The auxiliary light source is connected to the bracket. This produces the pivotal motion of the auxiliary light source about the second axis. The auxiliary light source is pivotally connected to the bracket to pivot about a third axis transverse to the second axis. A stop is provided to limit the pivoting of the auxiliary source about the third axis. Thus the light source has three degrees of adjustment, namely one, along the first axis of the telescopic members, two, pivoting about the second axis and three, pivoting about the third axis. Alternatively, the pair of telescopic members may rotate relative to each other. Again, a stop is provided to limit the relative rotation of the telescopic members. In this embodiment, the light source is pivotally connected to the first end of the telescopic members to pivot about the second axis transverse to the first axis.

In both embodiments, the telescopic members are pivotally connected at its second end to the support to pivot about a fourth axis transverse the first axis. The frame includes a stop and a spring biasing the telescopic members about the fourth axis towards the stop. A switch is provided adjacent the telescopic members to sense the pivoting about this fourth axis. This switch is a safety switch connected to the electrical system of the bed such that if the telescopic members pivot up, the safety switch will open and disconnect the power source to the bed.

A cover is coupled to the support frame and has a first contour extending from the support frame. A housing for the auxiliary light source has, in the stored position, a second contour extending from the support which is similar to the first contour of the cover. The auxiliary light source housing has opposed end walls which in the stored position are transverse to the support frame. The lamp of he auxiliary light source is positioned in the housing such that the illumination from the lamp exits an aperture in one of the end walls.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
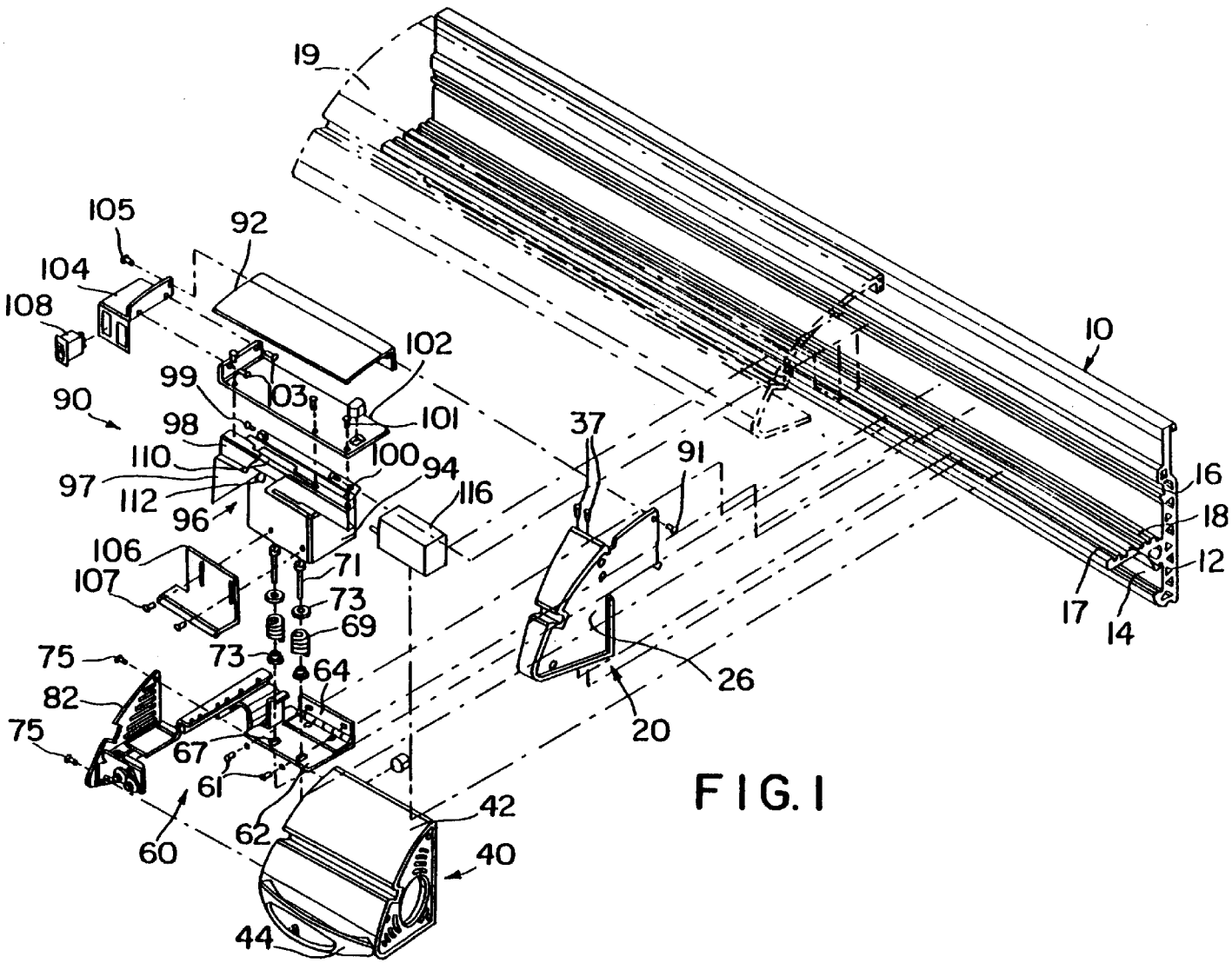
FIG. 1 is an exploded perspective view of a light fixture apparatus including the auxiliary light of a first embodiment of the present invention.
Figure 2:
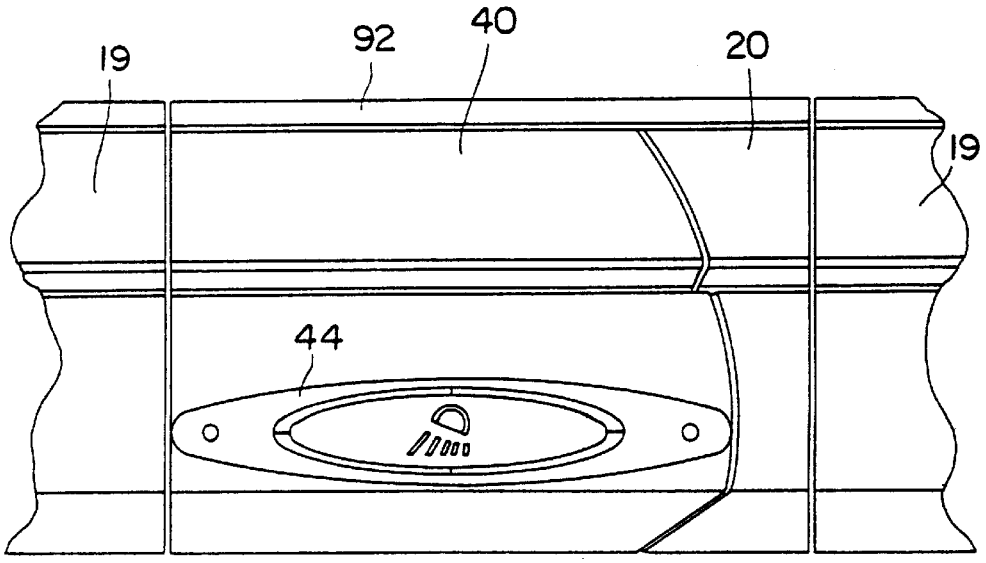
FIG. 2 is a front view of a light fixture apparatus with the auxiliary light in its stored position.

A light fixture apparatus according to the first embodiment of the present invention is illustrated in FIG. 1. The assembly includes a support frame 10 which is mounted to the wall of the room and having covers 19 mounted thereto which may cover compartments or include lights, electrical outlets and other related ancillary items. In an opening between a pair of covers 19 as illustrated in FIG. 2, an auxiliary light assembly 40 is included with filler wedge assembly 20. The contour of the wedge filler assembly 20 and the auxiliary light assembly 40 in its stored position illustrated in FIG. 2 and extending from the support frame is similar or matches the contour of the covers 19. Thus, when the auxiliary light assembly 40 is in its stored position, the light fixture apparatus has a uniformed contour except for the handle 44 of the auxiliary light assembly 40. The auxiliary light assembly 40 moves between its stored and deployed position by telescopic assembly 60 which also allows the auxiliary light assembly 40 to rotate or pivot about two transverse axis. A rail enclosure assembly 90 is also provided as part of the assemblies related to the auxiliary light assembly 40. Details of each of these assemblies will be described with respect to the remaining figures.

The support frame 10 includes the ledge 12 to support various elements as well as to provide a top to the track 14. Auxiliary equipment is received in tack 14 as described in the previously referenced patent application. Support frame 10 includes fastener channel 16 in its face wall as well as fastener channels 17 and 18 in the ledge 12.

Figure 3:
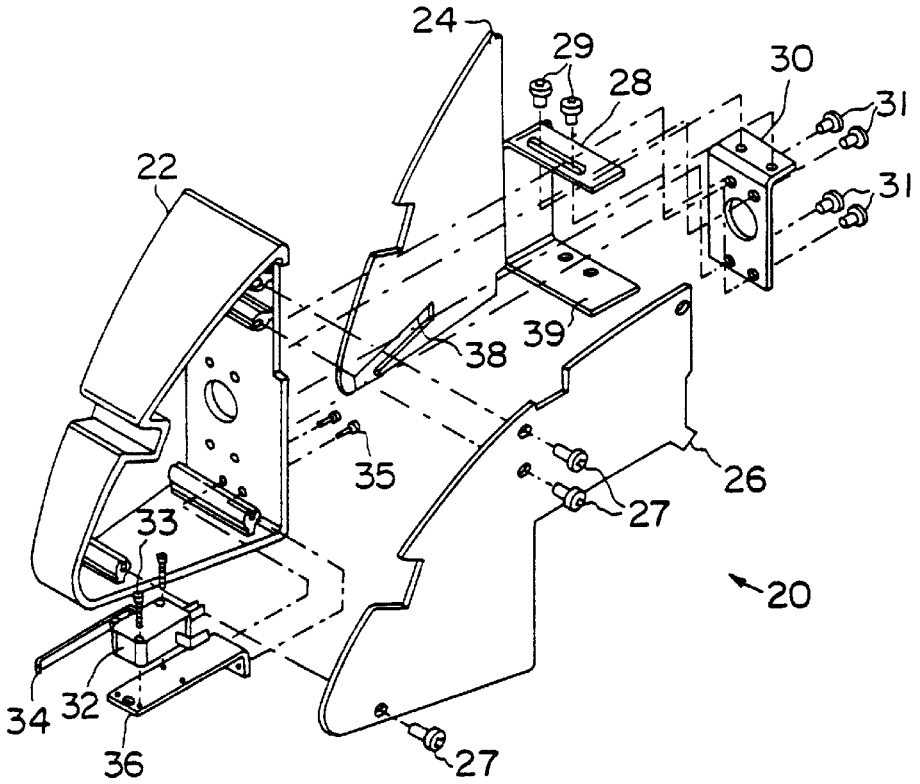
FIG. 3 is an exploded perspective view of a filler wedge incorporating the principles of the present invention.

The filler wedge assembly 20 is illustrated in FIG. 3 includes a wedge 22 having inside wall 24 and outside wall 26. A bracket at the back of inside wall 24, lying behind the wedge 22, is mounted to a bracket 30 by fasteners 29. Fasteners 31 mount the bracket 30 to the back wall of wedge 22. Fasteners 27 secure the outside wall 26 to the wedge 22. Switch 32 with feeler 34 is secured to bracket 36 by fasteners 33. Bracket 36 is secured to the wedge 22 by fasteners 35. The inside wall 24 has a slot 38 through which the feeler 34 extends. Switch 32 determines whether the auxiliary light assembly 40 is in its stored or deployed position. Fasteners 37 in FIG. 1 extend through openings in bracket 39 of the inside wall 24 and received in fastener channel 17 of ledge 12 to mount the filler assembly 20 to the support frame 10.

Figure 4:
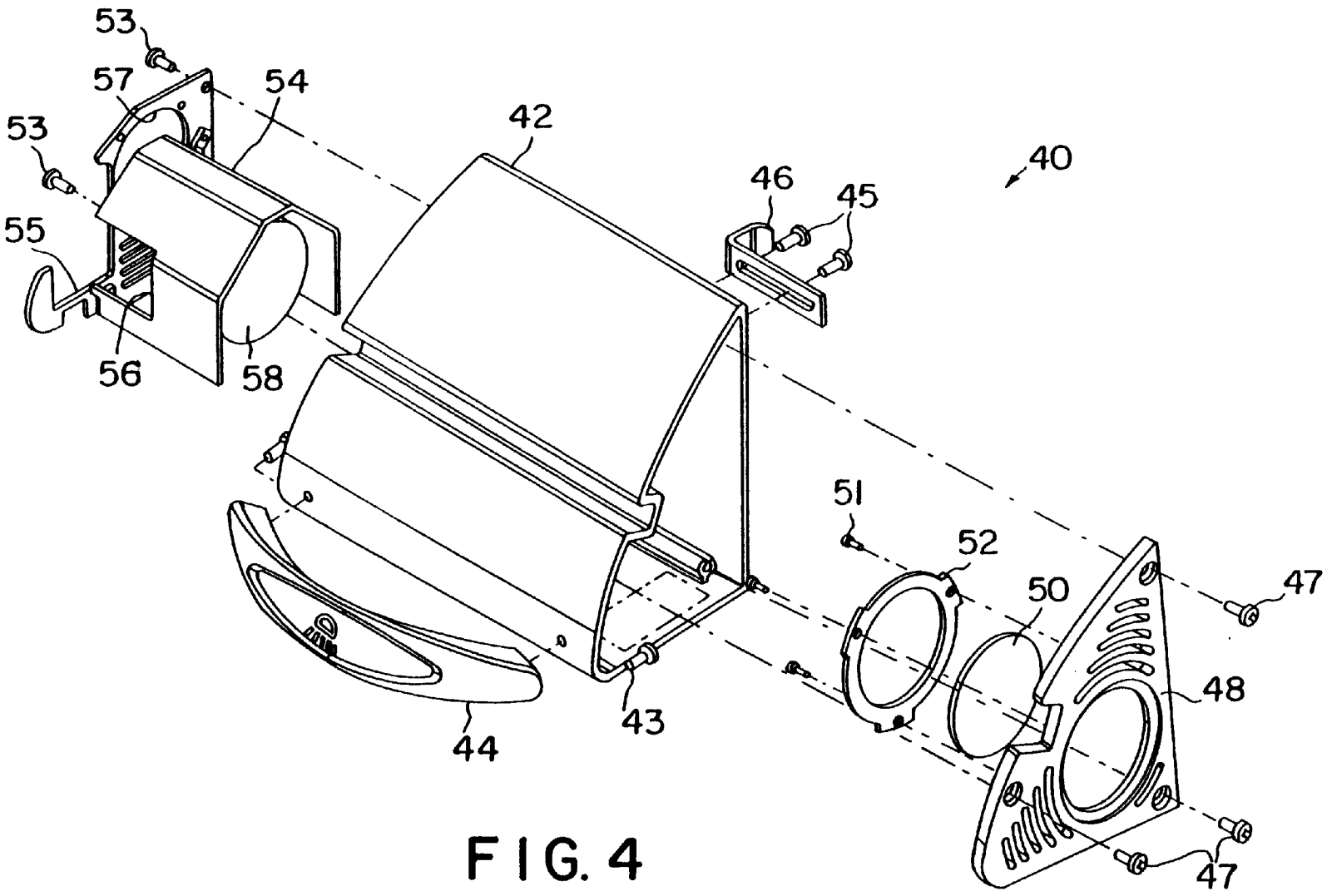
FIG. 4 is an exploded perspective view of the first embodiment of the light housing assembly.

The auxiliary light assembly 40 is illustrated in FIG. 4 and includes a housing 42 with a handle 44 secured thereto by fasteners 43. A slide guide 46 is mounted to the back of the housing 42 by fasteners 45 and engages wall 97 of the lower enclosure 94 of rail enclosure assembly 90 (see FIG. 1) to guide the auxiliary assembly into its appropriately stored position. A bezel 48, having lens 50 mounted thereto by retainer 52 and fasteners 51, is mounted to the end wall of housing 42 by fasteners 47. A heat sink assembly 54 including lamps 58 is mounted to the other end of housing 42 by fasteners 53. The lamp 58 preferably is halogen. The heat sink assembly 54 includes slots 55 and 56 therein to receive a portion extending from the other end wall plate 82 or mounting to the telescopic assembly 60. Opening 57 is also provided to receive a fan 59 to be described with respect to the second embodiment and illustrated in FIG. 9.

Figure 5:
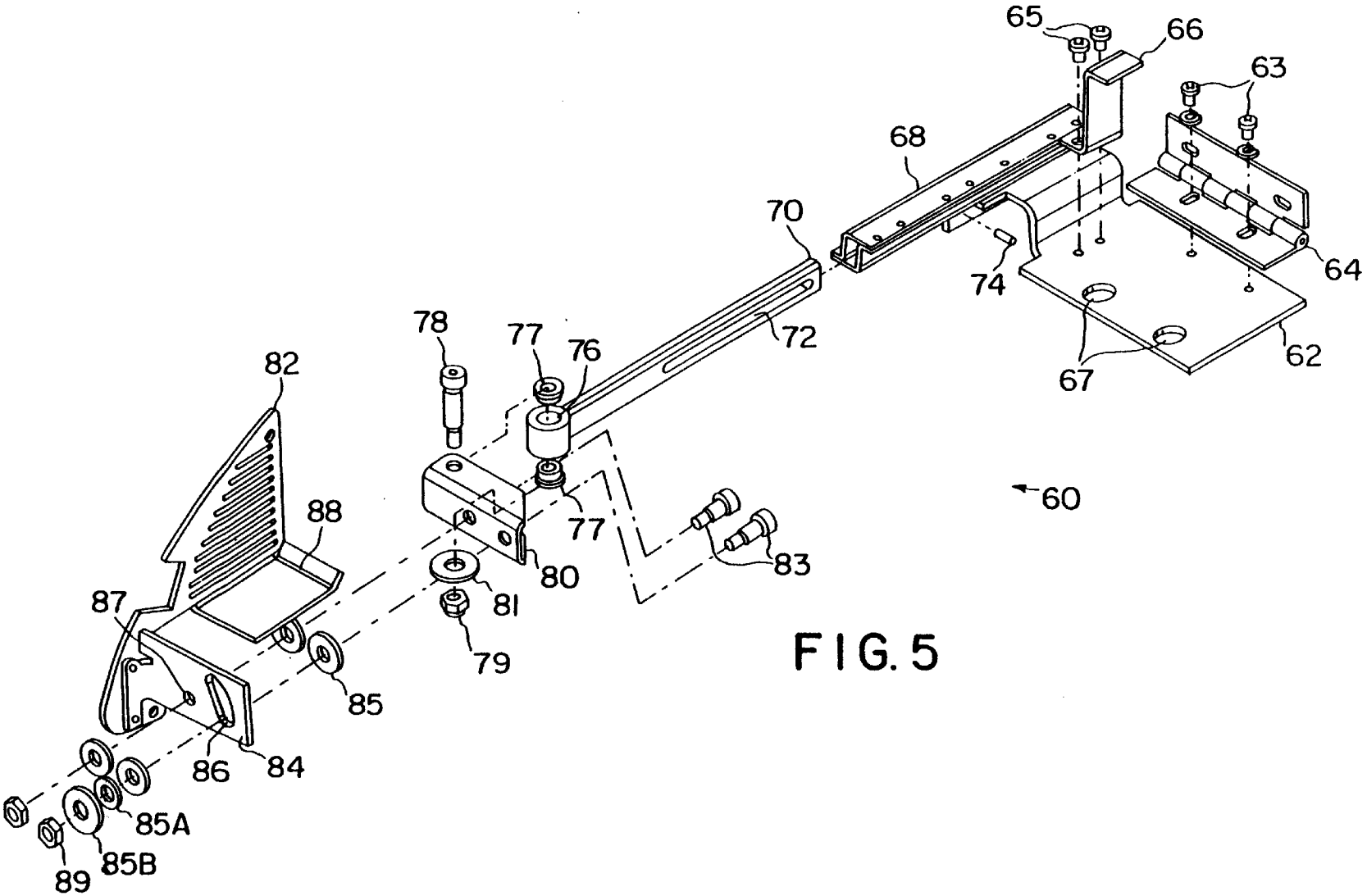
FIG. 5 is an exploded perspective view of the first embodiment of the telescopic assembly.

The telescopic assembly 60 is illustrated in detail in FIG. 5. A floating plate 62 includes a hinge 64 secured thereto by fasteners 63. Fasteners 61 through hinge 64 is received in and mounts the telescopic assembly to the support frame 10 (See FIG. 1). A Z-bracket 66 is mounted to floating plate 62 by fastener 65. As will be discussed below, Z-bracket 66 cooperates with a limit switch 110 of FIG. 1 to determine the position of the telescopic assembly 60 rotating about the axis of the hinge 64.

Extending from floating plate 62 is guide 68 for slide 70. Slide 70 includes an elongated recess 72 through which pin 74 extends and limits the telescopic movements of slide 70 within guide 68. At the end of slide 70, is an aperture 76 whose axis is an axis of rotation transverse to the sliding axis of slide 70. A screw 78 extends through bracket 80 which is a U-channel bracket and aperture 76 to pivotally mount the bracket 80 to the end of the slide 70. Bearings 77 are also received in aperture 76 and a nut 79 and washer 81 receive the end of the screw 78. The bearing 77 and the screw 78 may be brass impregnated with teflon. It should also be noted that slide 70 has a teflon coating and provides sufficient lubrication in the guide 68.

End wall 82, which forms the end wall of the auxiliary light assembly 40 includes a bracket 84. The bracket 84 includes an arcuate slot 86 and an opening 87. Fasteners 83 extend through the openings in the bracket 80 and slot 86 and opening 87 in the bracket 84. Washers 85 and nuts 89 are provided on fasteners 83. While parts 85 are flat washers, 85A is a conical washer and 85B is a thrust washer. The bracket 84 and consequently the end wall 82 and the light assembly 40 rotate about the fastener 83 in opening 87. The fastener 83 in the arcuate slot 86 defines the limit of rotation of end wall 82 and the auxiliary light assembly 40 to approximately under 90 degrees. Flange 88 extending from end wall 82 also extends over the slide 70. The slots 55 and 56 in the heat sink 54 receive the brackets 80 and 84. Fastener 75 of FIG. 1 mounts end wall 82 to the light assembly 40.

Referring to FIG. 1, springs 69 connected above floating plate 62 by fasteners 71 and spring retainers 73 extending through openings 67 of the floating plate 62 and into ledge 12 of the support frame 10. Spring 69 biases the floating plate 62 against the ledge 12 which operates as a stop. This maintains the telescopic assembly 60 in its horizontal position. If the bed or any element of the bed should knock up against the auxiliary light assembly 40, the floating plate 62 will pivot up against the springs 69. As will be discussed below, Z-bracket 66 will intersect safety switch 110 to indicate that the light assembly 40 has been moved from its normal position.

The rail enclosure assembly 90 as illustrated in FIG. 1 includes a top cover 92 secured to the outside wall 26 of the filler wedge assembly 20 by fastener 91. As shown in FIG. 2, the cover 92 is a continuation of the contour of housing 42 of the auxiliary light assembly. A lower enclosure 94 of the rail enclosure assembly 90 encloses the floating plate 62 and a substantial portion of the guide 68 and all of the spring 69. An opening 96 in the front wall of lower enclosure 94 allows the extension of the slide 70 therefrom and includes side wall 97. Mounted to the top of lower enclosure 94 is a channel 98. A flange 100 extending from the top of the lower enclosure 94 receives fasteners 99 which mounts the enclosure to the support frame 10 with the fasteners 99 being received in fastener channel 16.

A top plate 102 is mounted to the channel 98 by fasteners 101. This then forms the top enclosure. An upper enclosure 104 is mounted to the top element 102 by fasteners 103 and to the top cover 92 by fasteners 105. A support 106 is mounted to the front wall of lower enclosure 94 by fasteners 107. The support 106 engages the bottom of the auxiliary light assembly housing 42 and supports it in its stored position. An on/off switch 108 is mounted to the upper enclosure 104. A safety switch 110 is mounted to the top of lower enclosure 94 and has a plunger 112 extending down therefrom to be aligned with the Z-bracket 66 of the telescopic assembly 60. When the telescopic assembly 66 is rotated up out of its normal position, plunger 96 is depressed, opening switch 110 and disconnecting the circuitry to the bed.

A transformer 116 is secured to ledge 12 of the support bracket 10 by double back tape.

Figure 6:
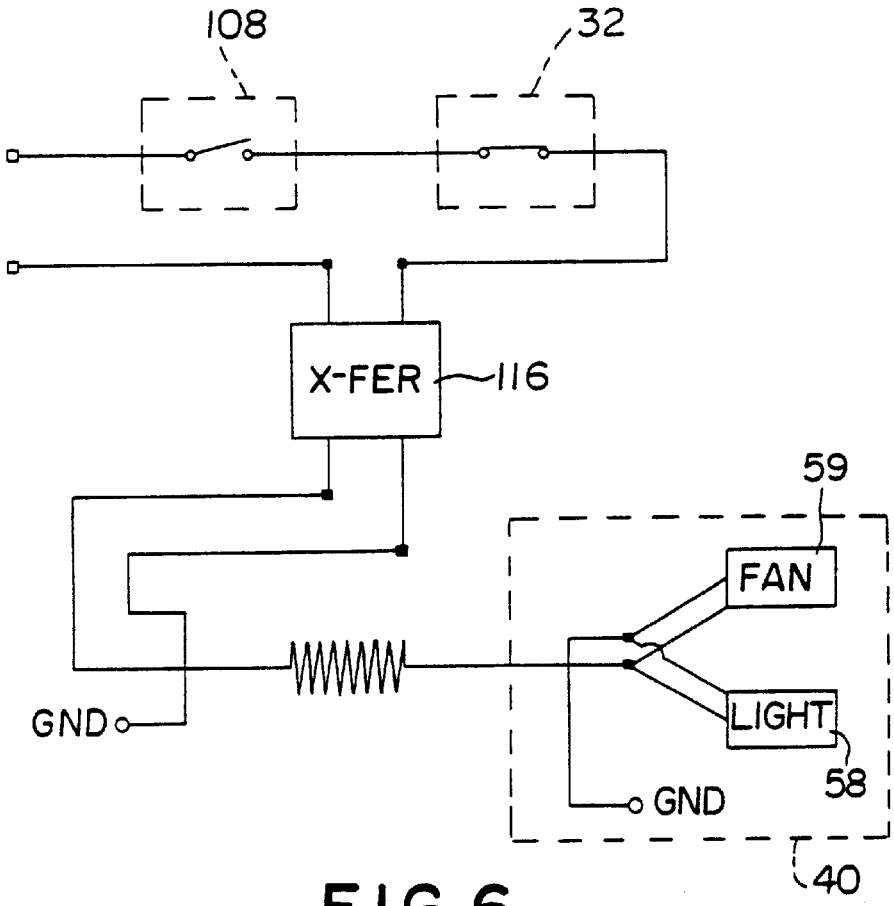
FIG. 6 is a schematic of the auxiliary light assembly circuit.

Referring to the schematic of FIG. 6, the on/off switch 108 is in series with the switch 32 which is closed when the light is in the extended position. They are connected through transformer 116 to light 58 and fan 59. Although the on/off switch 108 is shown to be connected to the support structure, it may also be provided on the auxiliary light assembly 40 if desired. If the on/off switch 108 happens to be closed when the auxiliary light assembly is moved into a stored position, switch 32 will open. This will prevent the light from staying on and from being overheated when it is stored.

Figure 7:
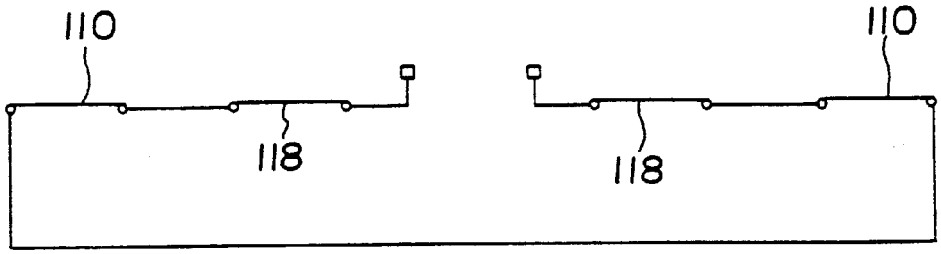
FIG. 7 is a schematic of the safety switch circuit.

The schematic for the safety circuit is illustrated in FIG. 7. Safety switch 110 which is open when the auxiliary light assembly, and more specifically, the telescopic assembly 60 is rotated from its normal position. Also illustrated is safety switch 118 which may be associated with other switches on the light fixture assembly connected to support frame 10. These safety switches are connected in series with the bed circuit. This is described in the aforementioned patent application.

Figure 8:
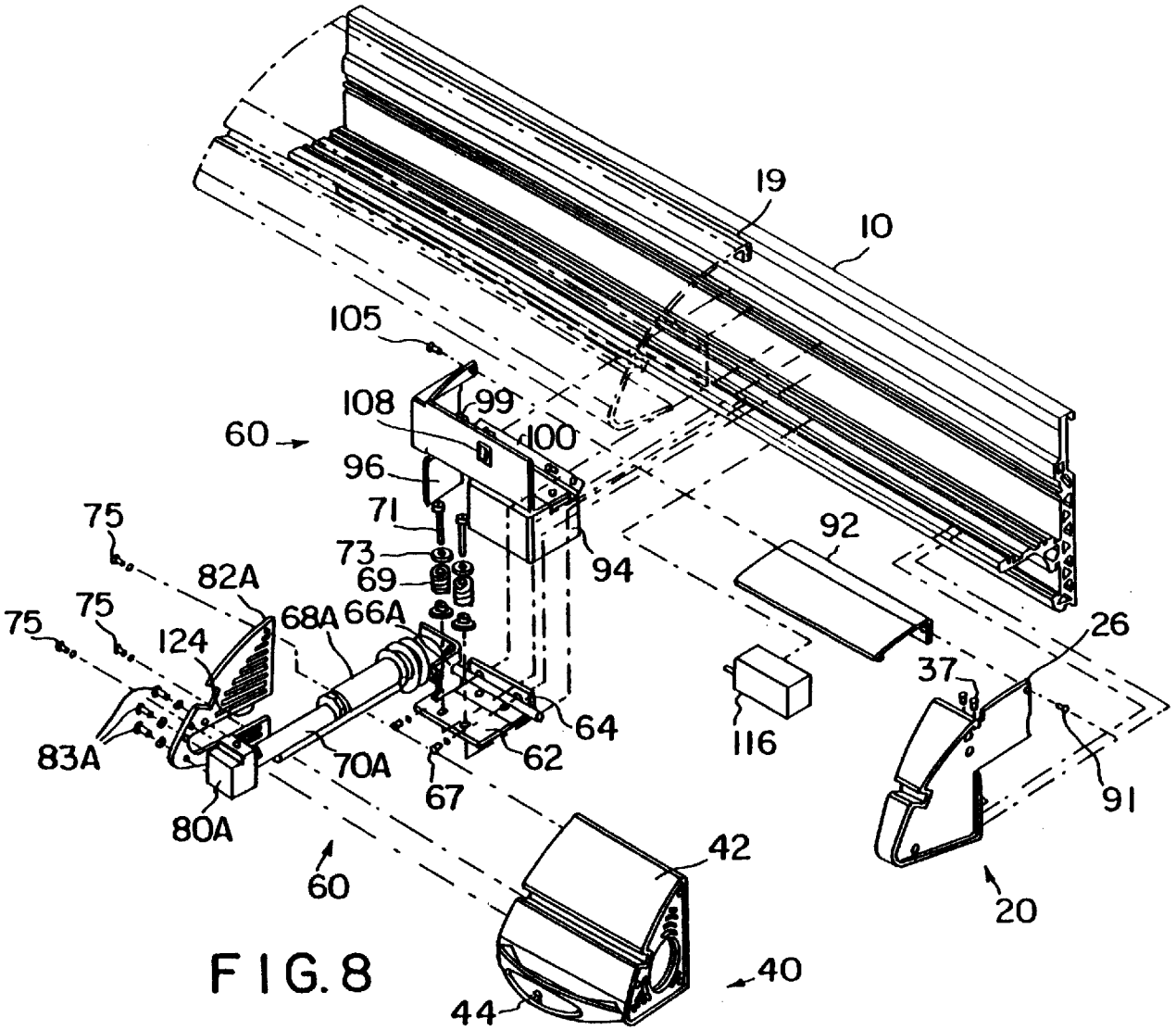
FIG. 8 is an exploded perspective view of a second embodiment of the light fixture apparatus according to the present invention.
Figure 9:
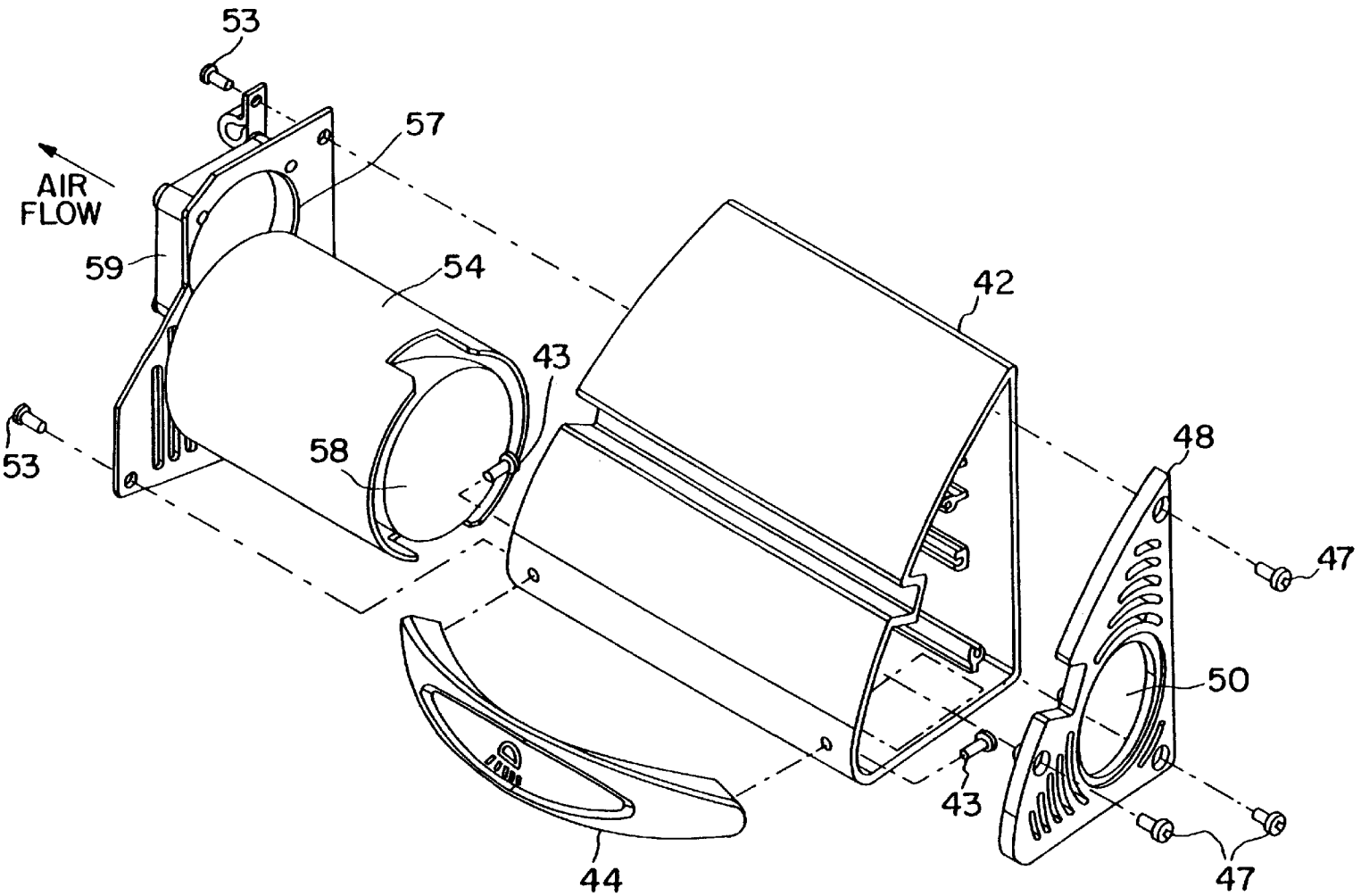
FIG. 9 is an exploded perspective view of the second embodiment of the light housing assembly.
Figure 10:
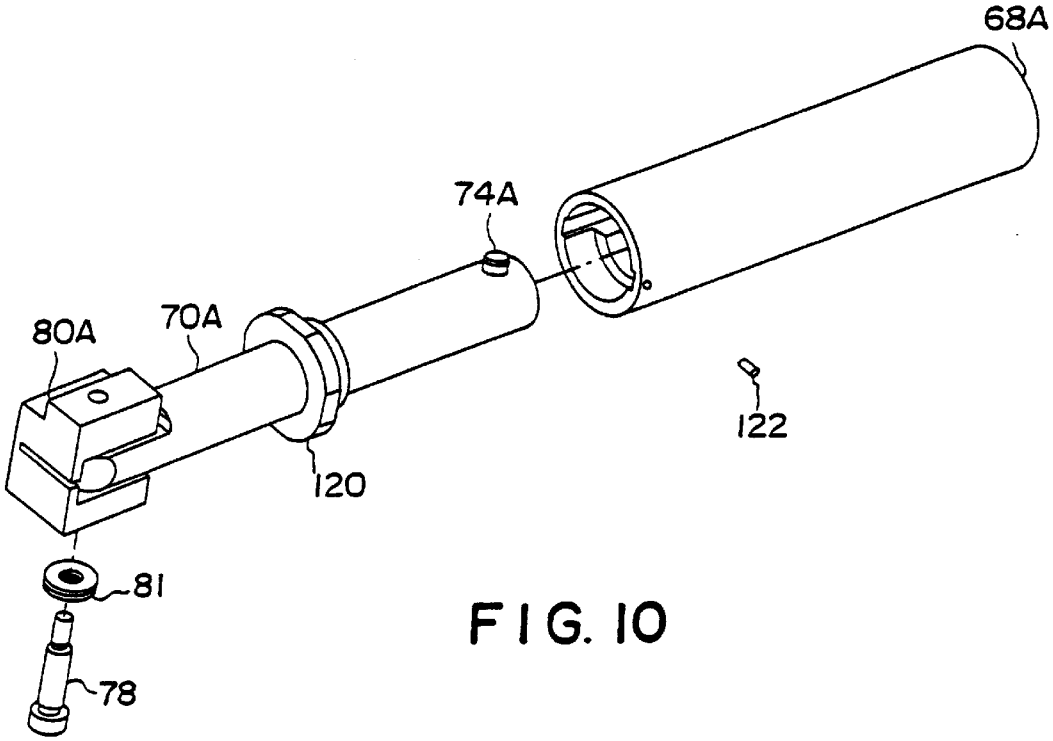
FIG. 10 is an exploded perspective view of the second embodiment of the telescopic assembly.

The second embodiment of the auxiliary light assembly is illustrated in FIG. 8–10. Those elements which have the same structures and functions have the same numbers as those of the embodiment of FIGS. 1–7. The filler wedge assembly 20 including switch 32 with feeler 34 is the same. The auxiliary light assembly 40 as illustrated in FIG. 9 is substantially the same except that a fan 59 has been added to the heat sink 54 drawing air through opening 57. Also, the shape of the heat sink 54 is shown as modified.

The major difference between the first and second embodiment is in the telescopic assembly 60. Those elements which have been modified have the letter "A". The bracket 66A extending from the floating plate 62 cooperates with safety switch 100 and plunger 112. Also mounted to bracket 66A is one end of the telescopic elements which includes guide tubes 68A and slide tube 70A. As shown in FIG. 10, the slide 70A includes a pin 74A extending therefrom and cooperates with a channel within guide 68A to limit the angular rotation of slide 70A with respect to guide 68A to approximately 90°. An end cap 120 is secured in the end of guide 68A and secured thereto by set screw 122. Pin 74A also engages the end cap 120 and therefore limits its extension along the first axis. Bracket 80A is pivotally mounted by screw 78 and washer 81 to the end of slide 70A. Fasteners 83A mount the end wall 82A to the bracket 80A. Slot 124 in end wall 82A allows the auxiliary light assembly 40 to rotate over the slide 70A.

The upper portion of the rail enclosure 90 has been modified with the location of the on/off switch 108 being centrally located. The location of the safety switch 110 and the structure of the lower enclosure 94 has not been modified from that of the embodiment of the previous figures.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A light fixture apparatus configured to be mounted to a wall of a room, the apparatus comprising:

a support frame to be mounted to the wall of the room;

a light box coupled to the support frame, the light box including a light source;

an auxiliary light source coupled to the support frame and movable from a first stored position to a second deployed position, the auxiliary light source being pivotable about a first axis and a second axis; and a first switch in series with the auxiliary light source and being open when the auxiliary light is in the stored position and closed when the auxiliary light is in the deployed position.

2. The apparatus of claim 1, including an on/off switch in series with the first switch and the auxiliary light source.

3. The apparatus of claim 2, wherein the on/off switch is coupled to the support frame.

4. The apparatus of claim 3, wherein the first switch is coupled to the support frame.

5. The apparatus of claim 1, wherein the first switch is coupled to the support frame.

6. The apparatus of claim 1, including a transformer coupled to the support frame and connected electrically to the first switch and the auxiliary light source.

7. The apparatus of claim 1, including a fan coupled to the auxiliary light source and connected electrically to the first switch and the auxiliary light source.

8. The apparatus of claim 1, including a pair of telescopic members movable relative to each other along a third axis and coupling the auxiliary light source to the support frame.

9. The apparatus of claim 8, wherein the auxiliary light source is rotatably connected to an end of one of the telescopic members.

10. The apparatus of claim 9, including a bracket pivotally connected to the end of one of the telescopic members to pivot about the first axis, the first axis being transverse to the third axis, and the auxiliary light source is connected to the bracket.

11. The apparatus of claim 10, wherein the auxiliary light source is pivotally connected to the bracket to pivot about the second axis, the second axis being transverse to the first axis.

12. The apparatus of claim 10, including a stop limiting the pivoting of the auxiliary light source about the second axis.

13. The apparatus of claim 1, including a pair of telescopic members movable relative to each other along the first axis and coupling the auxiliary light source to the support frame, the pair of telescopic members being rotatable relative to each other about the first axis.

14. The apparatus of claim 13, wherein the pair of telescopic members include a stop to limit the relative rotation.

15. The apparatus of claim 13, wherein the auxiliary light source is pivotally connected to an end of the telescopic members to pivot about a third axis transverse to the first axis.

16. The apparatus of claim 8, wherein the telescopic members are pivotally connected at a first end to the support frame to pivot about a fourth axis transverse to the third axis.

17. The apparatus of claim 16, wherein the support frame includes a stop and a spring biasing the telescopic members about the fourth axis towards the stop.

18. The apparatus of claim 16, including a switch adjacent the telescopic members to sense the pivoting about the fourth axis.

19. The apparatus of claim 1, including a cover coupled to the support frame and having a first contour extending from the support frame; and a housing for the auxiliary light source having, in the stored position, a second contour extending from the support frame which is similar to the first contour.

20. The apparatus of claim 1, wherein the auxiliary light source includes a housing with opposed end walls which, in the stored position, are transverse to the support frame.

21. The apparatus of claim 20, wherein the auxiliary light source includes a lamp in the housing and one of the end walls includes an aperture for illumination from the lamp.

22. The apparatus of claim 20, including a cover coupled to the support frame and having a first contour extending from the support frame; and an opening in the cover to receive the auxiliary light source in the stored position.

23. The apparatus of claim 22, wherein the housing for the auxiliary light source having, in the stored position, a second contour extending from the support frame which is similar to the first contour.

24. A light fixture apparatus configured to be mounted to a wall of a room, the apparatus comprising:

a support frame to be mounted to the wall of the room;

a light source coupled to the support frame and movable from a first stored position to a second deployed position, the light source being pivotable about a first axis and a second axis; and a first switch in series with the light source and being open when the light is in the stored position and closed when the light is in the deployed position.

25. The apparatus of claim 24, including an on/off switch in series with the first switch and the light source.

26. The apparatus of claim 24, including a pair of telescopic members movable relative to each other and coupling the auxiliary light source to the support frame.

27. The apparatus of claim 26, wherein the auxiliary light source is rotatably connected to an end of one of the telescopic members.

28. The apparatus of claim 24, including a pair of telescopic members movable relative to each other and coupling the light source to the support frame, the telescopic members being pivotally connected at a first end to the support frame to pivot about a third axis transverse to the first axis.

29. The apparatus of claim 28, wherein the support frame includes a stop and a spring biasing the telescopic members about the third axis towards the stop.

30. The apparatus of claim 28, including a switch adjacent the telescopic members to sense the pivoting about the third axis.

* * * * *